US012116880B2

(12) United States Patent
Viitala

(10) Patent No.: US 12,116,880 B2
(45) Date of Patent: Oct. 15, 2024

(54) ACTIVATING A REFERENCE POINT

(71) Applicant: SANDVIK MINING AND CONSTRUCTION OY, Tampere (FI)

(72) Inventor: Janne Viitala, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 3 days.

(21) Appl. No.: 17/924,782

(22) PCT Filed: May 12, 2021

(86) PCT No.: PCT/EP2021/062734
§ 371 (c)(1),
(2) Date: Nov. 11, 2022

(87) PCT Pub. No.: WO2021/229003
PCT Pub. Date: Nov. 18, 2021

(65) Prior Publication Data

US 2023/0175381 A1 Jun. 8, 2023

(30) Foreign Application Priority Data

May 13, 2020 (EP) ..... 20174463

(51) Int. Cl.
*E21B 44/02* (2006.01)
*E21B 7/02* (2006.01)

(52) U.S. Cl.
CPC ..... *E21B 44/02* (2013.01); *E21B 7/025* (2013.01)

(58) Field of Classification Search
CPC . E21B 44/02; E21B 7/025; E21B 7/02; E21B 15/003; E21B 43/30
See application file for complete search history.

(56) References Cited

U.S. PATENT DOCUMENTS

2012/0103598 A1* 5/2012 Nadeau ..... E21B 44/00 166/245
2012/0179322 A1* 7/2012 Hennessy ..... G05D 1/0278 701/25
2014/0172246 A1 6/2014 Farmer et al.
2016/0003009 A1* 1/2016 Oppolzer ..... E21B 41/00 175/24

FOREIGN PATENT DOCUMENTS

WO 2014131080 A1 9/2014

* cited by examiner

*Primary Examiner* — George S Gray
(74) *Attorney, Agent, or Firm* — Corinne R. Gorski

(57) ABSTRACT

An apparatus, method and computer program product arranged for receiving information on a path to be followed by a drilling rig, the path including a trigger position, determining a position of the drilling rig, instructing the drilling rig to follow the path based on a first reference point associated with the drilling rig, activating, in response to determining that the position of the drilling rig corresponds to the trigger position, a second reference point associated with the drilling rig, and instructing the drilling rig to stop in response to determining that a position of the second reference point corresponds to a target position.

15 Claims, 3 Drawing Sheets

ACTIVATING A REFERENCE POINT

RELATED APPLICATION DATA

This application is a § 371 National Stage Application of PCT International Application No. PCT/EP2021/062734 filed May 12, 2021 claiming priority to EP 20174463.8 filed May 13, 2020.

TECHNICAL FIELD

The present application relates generally to a drilling rig. More specifically, the present application relates to instructing a drilling rig to follow a path based on a reference point.

BACKGROUND

Drilling rigs are used for drilling holes in different kinds of circumstances.

SUMMARY

Various aspects of examples of the invention are set out in the claims. The scope of protection sought for various embodiments of the invention is set out by the independent claims. The examples and features, if any, described in this specification that do not fall under the scope of the independent claims are to be interpreted as examples useful for understanding various embodiments of the invention.

According to a first aspect of the invention, there is provided an apparatus comprising means for performing: receiving information on a path to be followed by a drilling rig, the path comprising a trigger position, determining a position of the drilling rig, instructing the drilling rig to follow the path based on a first reference point associated with the drilling rig, activating, in response to determining that the position of the drilling rig corresponds to the trigger position, a second reference point associated with the drilling rig, and instructing the drilling rig to stop in response to determining that a position of the second reference point corresponds to a target position.

According to a second aspect of the invention, there is provided a method comprising: receiving information on a path to be followed by a drilling rig, the path comprising a trigger position, determining a position of the drilling rig, instructing the drilling rig to follow the path based on a first reference point associated with the drilling rig, activating, in response to determining that the position of the drilling rig corresponds to the trigger position, a second reference point associated with the drilling rig, and instructing the drilling rig to stop in response to determining that a position of the second reference point corresponds to a target position.

According to a third aspect of the invention, there is provided a computer program comprising instructions for causing an apparatus to perform at least the following: receiving information on a path to be followed by a drilling rig, the path comprising a trigger position, determining a position of the drilling rig, instructing the drilling rig to follow the path based on a first reference point associated with the drilling rig, activating, in response to determining that the position of the drilling rig corresponds to the trigger position, a second reference point associated with the drilling rig, and instructing the drilling rig to stop in response to determining that a position of the second reference point corresponds to a target position.

According to a fourth aspect of the invention, there is provided an apparatus comprising at least one processor and at least one memory including computer program code, the at least one memory and the computer program code configured to with the at least one processor, cause the apparatus at least to: receive information on a path to be followed by a drilling rig, the path comprising a trigger position, determine a position of the drilling rig, instruct the drilling rig to follow the path based on a first reference point associated with the drilling rig, activate, in response to determining that the position of the drilling rig corresponds to the trigger position, a second reference point associated with the drilling rig, and instruct the drilling rig to stop in response to determining that a position of the second reference point corresponds to a target position.

According to a fifth aspect of the invention, there is provided a non-transitory computer readable medium comprising program instructions for causing an apparatus to perform at least the following: receiving information on a path to be followed by a drilling rig, the path comprising a trigger position, determining a position of the drilling rig, instructing the drilling rig to follow the path based on a first reference point associated with the drilling rig, activating, in response to determining that the position of the drilling rig corresponds to the trigger position, a second reference point associated with the drilling rig, and instructing the drilling rig to stop in response to determining that a position of the second reference point corresponds to a target position.

According to a sixth aspect of the invention, there is provided a computer readable medium comprising program instructions for causing an apparatus to perform at least the following: receiving information on a path to be followed by a drilling rig, the path comprising a trigger position, determining a position of the drilling rig, instructing the drilling rig to follow the path based on a first reference point associated with the drilling rig, activating, in response to determining that the position of the drilling rig corresponds to the trigger position, a second reference point associated with the drilling rig, and instructing the drilling rig to stop in response to determining that a position of the second reference point corresponds to a target position.

BRIEF DESCRIPTION OF THE DRAWINGS

Some example embodiments will now be described with reference to the accompanying drawings.

DETAILED DESCRIPTION OF THE DRAWINGS

The following embodiments are exemplifying. Although the specification may refer to "an", "one", or "some" embodiment(s) in several locations of the text, this does not necessarily mean that each reference is made to the same embodiment(s), or that a particular feature only applies to a single embodiment. Single features of different embodiments may also be combined to provide other embodiments.

Example embodiments relate to a drilling rig. More particularly, example embodiments relate to instructing a drilling rig to follow a path based on a reference point.

A drilling rig may be driven using a selected reference point as a position of the drilling rig. A reference point may be, for example, a centre of gravity of the drilling rig that enables accurately following a path while taking into account dimensions of the drilling rig. For example, when using a centre of gravity of the drilling rig as the position of the drilling rig, the drilling rig may be driven past obstacles in a predictable manner. However, the drill bit for drilling a hole might not be aligned with the centre of gravity, which makes it difficult to position the drill bit accurately.

An example embodiment relates to an apparatus configured to receive information on a path to be followed by a drilling rig, the path comprising a trigger position, determine a position of the drilling rig, instruct the drilling rig to follow the path based on a first reference point associated with the drilling rig, activate, in response to determining that the position of the drilling rig corresponds to the trigger position, a second reference point associated with the drilling rig, and instruct the drilling rig to stop in response to determining that a position of the second reference point corresponds to a target position.

Figure 1:
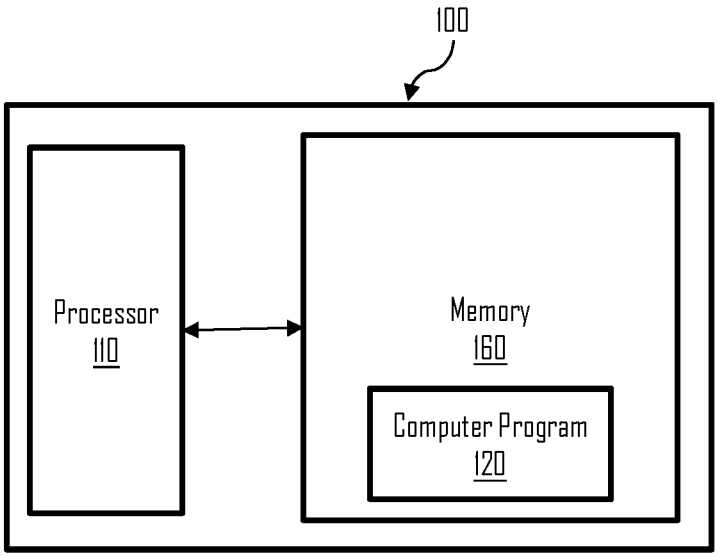
FIG. 1 shows a block diagram of an example apparatus in which examples of the disclosed embodiments may be applied.

FIG. 1 is a block diagram depicting an apparatus 100 operating in accordance with an example embodiment of the invention. The apparatus 100 may be, for example, an electronic device such as a module comprised by an automation or control system, a chip or a chipset. The apparatus 100 comprises one or more control circuitry, such as at least one processor 110 and at least one memory 160, including one or more algorithms such as computer program instructions 120 wherein the at least one memory 160 and the computer program instructions are configured, with the at least one processor 110 to cause the apparatus to carry out any of example functionalities described below.

In the example of FIG. 1, the processor 110 is a control unit operatively connected to read from and write to the memory 160. The processor 110 may also be configured to receive control signals received via an input interface and/or the processor 110 may be configured to output control signals via an output interface. In an example embodiment the processor 110 may be configured to convert the received control signals into appropriate commands for controlling functionalities of the apparatus.

The at least one memory 160 stores computer program instructions 120 which when loaded into the processor 110 control the operation of the apparatus 100 as explained below. In other examples, the apparatus 100 may comprise more than one memory 160 or different kinds of storage devices.

Computer program instructions 120 for enabling implementations of example embodiments of the invention or a part of such computer program instructions may be loaded onto the apparatus 100 by the manufacturer of the apparatus 100, by a user of the apparatus 100, or by the apparatus 100 itself based on a download program, or the instructions can be pushed to the apparatus 100 by an external device. The computer program instructions may arrive at the apparatus 100 via an electromagnetic carrier signal or be copied from a physical entity such as a computer program product, a memory device or a record medium such as a USB stick, a Compact Disc (CD), a Compact Disc Read-Only Memory (CD-ROM), a Digital Versatile Disk (DVD) or a Blu-ray disk.

Figure 2:
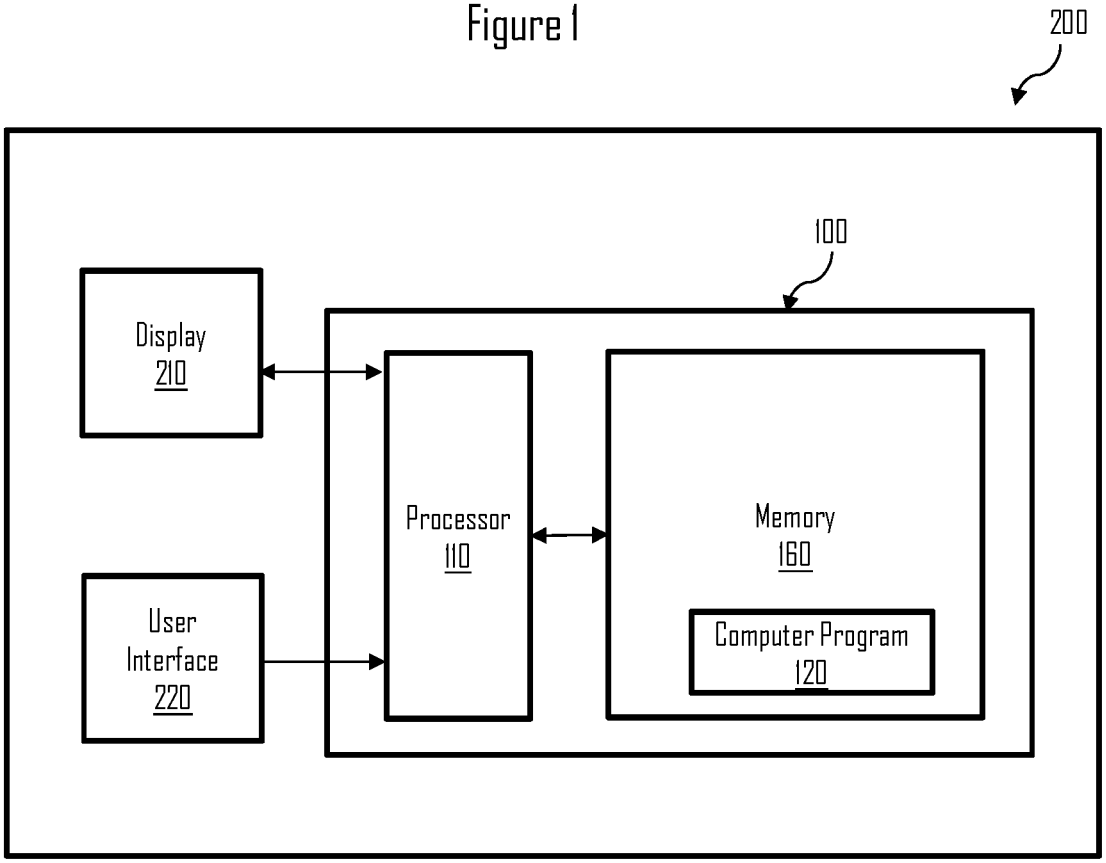
FIG. 2 shows a block diagram of another example apparatus in which examples of the disclosed embodiments may be applied.

FIG. 2 is a block diagram depicting an apparatus 200 in accordance with an example embodiment of the invention. The apparatus 200 may be an electronic device such as a module comprised by an automation system or a control system, a Personal Computer (PC), a laptop, a desktop, a wireless terminal, a communication terminal, a computing device or the like. In the examples below it is assumed that the apparatus 200 is a computing device.

In the example embodiment of FIG. 2, the computing device 200 is illustrated as comprising the apparatus 100, a display 210 and a user interface 220 for interacting with the computing device 200. The display 210 may also be configured to act as a user interface. For example, the display may be a touch screen display. In an example embodiment, the display 210 and/or the user interface 220 may be external to the apparatus 200, but in communication with it.

Additionally or alternatively, the user interface may also comprise a manually operable control such as a button, a key, a touch pad, a joystick, a stylus, a pen, a roller, a rocker, a keypad, a keyboard or any suitable input mechanism for inputting and/or accessing information.

The computing device 200 of the example of FIG. 2 may also be configured to establish radio communication with another device using, for example, a cellular network, a Bluetooth or WiFi connection or the like.

The apparatus 200 may be implemented in the drilling rig or the apparatus 200 may be a module operatively connected to the drilling rig. For example, the apparatus 200 may be configured to communicate with the drilling rig via a wireless connection.

A drilling rig may comprise, for example, a surface drilling rig such as a surface top hammer drill rig, a surface down-the-hole drill rig, a dimensional stone drill rig, or a rotary blasthole drill rig. A drilling rig may be used for exploration drilling such as identifying a location and quality of a mineral, for production drilling such as mining and/or for pre-splitting. A drilling rig may comprise a drilling rig controlled by a driver or an operator, or an autonomous drilling rig enabling remote use or a semi-automatic drilling rig enabling remote use and/or local use.

According to an example embodiment, the apparatus 200 is configured to receive information on a path to be followed by a drilling rig, the path comprising a trigger position. The apparatus 200 may be configured to receive the information on a path to be followed from a drill plan that comprises drill hole data on a plurality of drill holes to be drilled at a drilling site. A drilling site comprises a drilling area comprising a plurality target holes. A drilling area may comprise a geographical area. The geographical area may be limited by virtual boundaries. According to an example embodiment, a drilling area comprises a geo-fence that comprises a virtual perimeter corresponding to a real-world geographic area. The drill plan may be stored on the apparatus 200 or the apparatus 200 may be configured to receive the drill plan from a separate device. According to an example embodiment, a drill plan comprises a digital drill plan.

The path may be followed using a reference point associated with the drilling rig. The position of the reference point may be considered as the position of the drilling rig by a position control algorithm controlling movement of the drilling rig.

According to an example embodiment, the apparatus 200 is configured to instruct a position control algorithm controlling movement of the drilling rig to use a reference point associated with the drilling rig to follow the path. According to an example embodiment, the apparatus 200 is configured to instruct the drilling rig to follow the path based on a reference point associated with the drilling rig.

A trigger position may comprise a position that triggers the apparatus 200 to perform a function, change a setting, control the drilling rig or the like. According to an example embodiment, the trigger position comprises a position within a predetermined distance from a target position. The predetermined distance may be, for example, a percentage value of the length of the drilling rig. For example, the predetermined distance may be 10-30% of the length of the drilling rig. As another example, the predetermined distance may comprise, for example, a set numerical value comprising a distance of centimetres, tens of centimetres, a metre, of few metres, or the like.

According to an example embodiment, the trigger position comprises a position for selecting a reference point associated with the drilling rig. As mentioned above, the reference point may be used as a reference point for following the path. For example, the trigger position may comprise a position for switching from using a first reference point to using a second reference point, a position for activating a reference point, a position for deactivating a previously used reference point, a position for replacing a first reference point with a second reference point, or the like.

The trigger position may comprise, for example, geographical coordinates defining a point or an area. The geographical coordinates may comprise, for example, global positioning system (GPS) coordinates, global navigation satellite system coordinates (GNSS) or the like. According to an example embodiment, the trigger position comprises a segment of the path.

A path to be followed by a drilling rig may comprise at least a portion of a route to a target position. According to an example embodiment, the path comprises a path to a target position. The path to the target position may comprise a pre-determined path or a path that is calculated based on at least one pre-determined criterion. The at least one pre-determined criterion may comprise, for example, a defined time interval for calculating the path or an instruction to determine the path in real-time.

A target position may comprise a position relating to operating the drilling rig or performing an operation using the drilling rig. According to an example embodiment, a target position comprises a position of a hole to be drilled. A target position such as a target hole to be drilled may be defined, for example, using X and Y coordinates with respect to a defined reference point. As another example, a target position may be defined using X, Y and Z coordinates such that also altitude is taken into account.

A target position may comprise a physical location of a drilling rig. A physical location may comprise an absolute location such as a location corresponding to geographical coordinate values such GPS coordinates or a relative location such as a location relative to, for example, a drilling site. A target position may be defined in a drill plan comprising drill hole data.

Drill hole data may comprise different kinds of data. For example, drill hole data may comprise position data such as geographical coordinates for one or more holes to be drilled, characteristic data such as drill depth, drilling order and/or the like.

The apparatus 200 may be configured to receive information on a target position from a user or from another device. According to an example embodiment, the apparatus 200 is configured to receive information on a target position in response to a user input. A user input may be provided, for example, on a touch screen of the apparatus 200 or of a separate device operatively connected to the apparatus 200. A user input may comprise, for example, a touch gesture on a touch screen.

According to an example embodiment, the path comprises a path to the trigger position. Similarly to a path to the target position, the path to the trigger position may comprise a pre-determined path or a path that is calculated based on at least one pre-determined criterion. The at least one pre-determined criterion may comprise, for example, a defined time interval for calculating the path or an instruction to determine the path in real-time.

A trigger position may comprise a physical location of a drilling rig. A physical location may comprise an absolute location such as a location corresponding to geographical coordinate values such as global positioning system (GPS) coordinates or a relative location such as a location relative to, for example, a drilling site.

According to an example embodiment, the apparatus 200 is configured to determine a position of the drilling rig. A position of the drilling rig may comprise an absolute position or a relative position. An absolute position may comprise, for example, geographical coordinates such as global positioning system (GPS) coordinates. A relative position may comprise, for example, a position of the drilling rig with respect to a determined drill site. The apparatus 200 may be configured to determine a position of the drilling rig based on information received from a separate device or service, or the apparatus 200 may be configured to determine the position of the drilling rig.

According to an example embodiment, the position of the drilling rig comprises a dynamic position. In other words, information on the position of the drilling rig may be updated in response to movement of the drilling rig, at set time intervals, or the like.

According to an example embodiment, the apparatus 200 is configured to instruct the drilling rig to follow the path based on a first reference point associated with the drilling rig.

According to an example embodiment, the first reference point associated with the drilling rig comprises a point of the drilling rig that is input to the position control algorithm as a default value. For example, the first reference point may comprise a point of the drilling rig that is input to the position control algorithm when drilling of a hole is finished, when the drilling rig is tramming, or the like.

According to an example embodiment, the apparatus 200 is configured to activate, in response to determining that the position of the drilling rig corresponds to the trigger position, a second reference point associated with the drilling rig. Therefore, assuming the first reference point is, for example, the centre of gravity of the drilling rig, the apparatus 200 is configured to activate a second reference point associated with the drilling rig in response to determining that the centre of gravity of the drilling rig corresponds to the trigger position.

Activating the second reference point may comprise, for example, providing the second reference point for the position control algorithm or enabling use of the second reference point for the position control algorithm. Activating the second reference point may further comprise deactivating the first reference point, replacing the first reference point with the second reference point, using the second reference point instead of the first reference point, or the like.

According to an example embodiment, the second reference point associated with the drilling rig comprises a drill bit position.

Without limiting the scope of the claims, an advantage of the second reference point comprising the drill bit position may be that the drill bit may be positioned accurately.

According to an example embodiment, the first reference point associated with the drilling rig is different from the second reference point associated with the drilling rig.

According to an example embodiment, the apparatus 200 is configured to determine a path from the trigger position to the target position. The apparatus 200 may be configured to determine the path from the trigger position to the target position in response to determining that the position of the drilling rig corresponds to the trigger position.

The apparatus 200 may be configured to instruct the drilling rig to follow the path from the trigger position to the target position based on the first reference point or the second reference. Therefore, the apparatus 200 may be configured to maintain the first reference point while activating the second reference point.

According to an example embodiment, the apparatus 200 is configured to instruct the drilling rig to follow a path from the trigger position to the target position based on the first reference point.

According to another example embodiment, the apparatus 200 is configured to instruct the drilling rig to follow a path from the trigger position to the target position based on the second reference point. For example, the apparatus 200 may be configured to instruct the drilling rig to follow the path based on the first reference point until reaching the trigger position and switch from the using the first reference point to using the second reference point for following the path and instruct the drilling rig to follow the path based on the second reference point from the trigger position to the target position.

Switching from using the first reference point to the second reference point may require determining an additional path for covering the distance between the first reference point and the second reference point.

According to an example embodiment, the apparatus 200 is configured to generate an additional path from the position of the second reference point to the trigger position.

Without limiting the scope of the claims, an advantage of generating an addition path from the position of the second reference point to the trigger position may be that gaps in the path may be avoided.

According to an example embodiment, the apparatus 200 is configured to instruct the drilling rig to stop in response to determining that a position of the second reference point corresponds to a target position.

According to an example embodiment, the apparatus 200 comprises means for receiving information on a path to be followed by a drilling rig, the path comprising a trigger position, means for determining a position of the drilling rig, means for instructing the drilling rig to follow the path based on a first reference point associated with the drilling rig, means for activating, in response to determining that the position of the drilling rig corresponds to the trigger position, a second reference point associated with the drilling rig, and means for instructing the drilling rig to stop in response to determining that the position of the second reference point corresponds to a target position.

The apparatus may further comprise means for determining a path from the trigger position to the target position, means for instructing the drilling rig to follow a path from the trigger position to the target position based on the first reference point, means for instructing the drilling rig to follow a path from the trigger position to the target position based on the second reference point and/or means for generating an additional path from the position of the second reference point to the trigger position.

Figure 3:
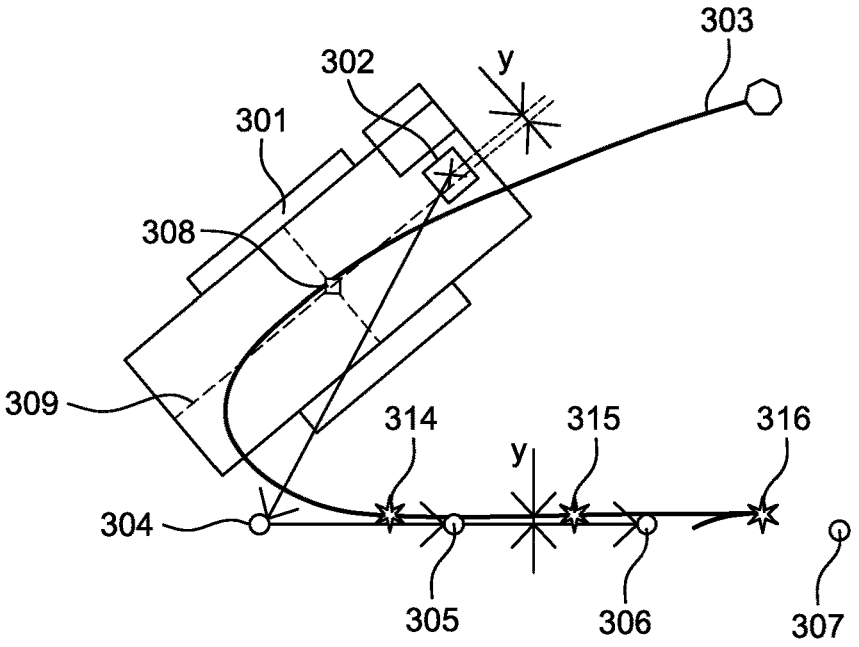
FIG. 3 illustrates an example of activating a reference point.

FIG. 3 illustrates an example of activating a second reference point. More specifically, the example of FIG. 3 illustrates a situation when the apparatus 200 is configured to instruct a drilling rig 301 to follow a path 303 based on a first reference point 308 and stop based on a second reference point 302. In the example of FIG. 3, the first reference point 308 comprises a centre of gravity of the drilling rig 301 and the second reference point 302 comprises a position of the drilling rig. However, it should be noted that the first reference point and the second reference point may comprise any suitable points that are used by the position control algorithm as reference points for navigating the drilling rig 301.

The path 303 comprises a path in a drill plan for drilling holes 304, 305, 306 and 307 using a drill bit 302. As indicated in the example of FIG. 3, the drill bit 302 is offset from the centre of gravity by distance y from a longitudinal axis 309 of a body of the drilling rig 301. In other words, if the drilling rig 301 were to be instructed to follow the path 303 based on the first reference point 308 and stop based on the first reference point 308, the drill bit would not be in a correct position when starting drilling, for example, the hole 304.

In the example of FIG. 3, the apparatus 200 is configured to instruct the drilling rig 301 to follow a path 303 based on a first reference point 308 and activate the second reference point 302 in response to determining that the position of the drilling rig 301 corresponds to a trigger position 314.

Activating the second reference point 302 may comprise, for example, providing the second reference point 302 for the position control algorithm or enabling use of the second reference point 302 for the position control algorithm. Activating the second reference point may further comprise deactivating the first reference point 308, replacing the first reference point 308 with the second reference point 302, using the second reference point 302 instead of the first reference point 308, or the like.

In the example of FIG. 3, activating the second reference point 302 comprises enabling use of the second reference 302 for stopping the drilling rig 301. In other words, the apparatus 200 is configured to instruct the drilling rig 301 to follow the path 303 based on the first reference point 308 and instruct the drilling rig 301 to stop in response to determining that the position of the second reference point 302 corresponds to a position of the hole 304. Therefore, the first reference point 308 and the second reference point 302 may be concurrently active but used for different things.

Figure 4:
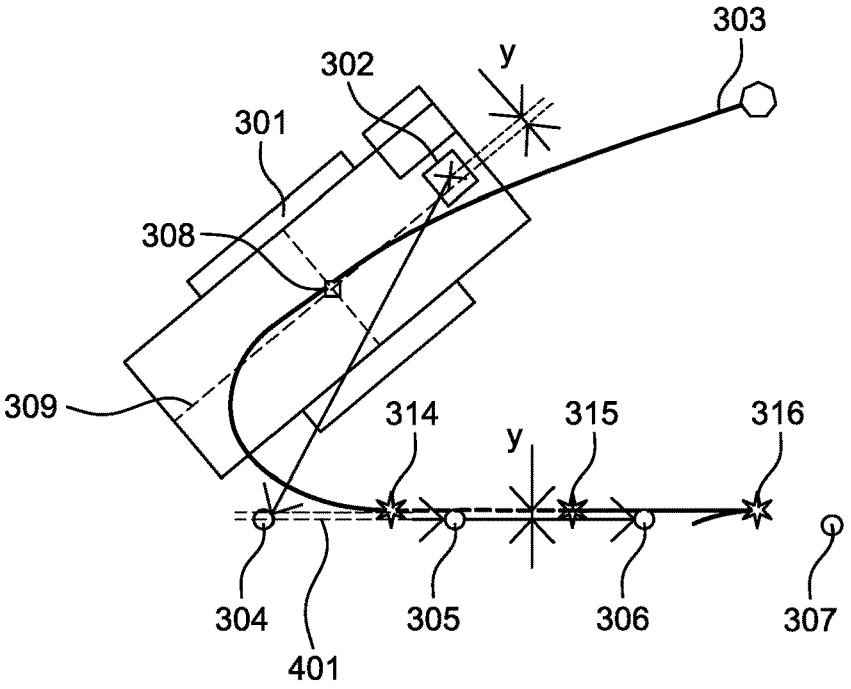
FIG. 4 illustrates another example of activating a reference point.

FIG. 4 illustrates another example of activating a second reference point. Similarly to the example of FIG. 3, FIG. 4 illustrates a situation when the apparatus 200 is configured to instruct a drilling rig 301 to follow a path 303 based on a first reference point 308 and stop based on a second reference point 302. In the example of FIG. 4, the first reference point 308 comprises a centre of gravity of the drilling rig 301 and the second reference point 302 comprises a position of the drilling rig. However, it should be noted that the first reference point and the second reference point may comprise any suitable points that are used by the position control algorithm as reference points for navigating the drilling rig 301.

The path 303 comprises a path in a drill plan for drilling holes 304, 305, 306 and 307 using a drill bit 302. As indicated in the example of FIG. 4, the drill bit 302 is offset from the centre of gravity by distance y from a longitudinal axis 309 of a body of the drilling rig 301. In other words, if the drilling rig 301 were to be instructed to follow the path 303 based on the first reference point 308 and stop based on the first reference point 308, the drill bit would not be in a correct position when starting drilling, for example, the hole 304.

In the example of FIG. 4, the apparatus 200 is configured to instruct the drilling rig 301 to follow a path 303 based on a first reference point 308 and activate the second reference point 302 in response to determining that the position of the drilling rig 301 corresponds to a trigger position 314.

Activating the second reference point 302 may comprise, for example, providing the second reference point 302 for the position control algorithm or enabling use of the second reference point 302 for the position control algorithm. Activating the second reference point may further comprise deactivating the first reference point 308, replacing the first reference point 308 with the second reference point 302, using the second reference point 302 instead of the first reference point 308, or the like.

In the example of FIG. 4, activating the second reference point 302 comprises deactivating the first reference point 308 and enabling use of the second reference point 302 for following the path 303 and stopping the drilling rig 301. In other words, the apparatus 200 is configured to instruct the drilling rig 301 to follow the path 303 based on the second reference point 302 and instruct the drilling rig 301 to stop in response to determining that the position of the second reference point 302 corresponds to a position of the hole 304. In other words, the apparatus 200 is configured to switch from using the first reference point 308 to using the second reference point 302.

When a reference point is switched from the first reference point 308 to the second reference point 302 at the trigger position 314, there will be a gap in position information of the drilling rig 301 due to the physical distance between the first reference point 308 and the second reference point 302. Therefore, the apparatus 200 is configured to generate an additional path 401 from the position of the second reference point 302 to the trigger position 314.

Figure 5:
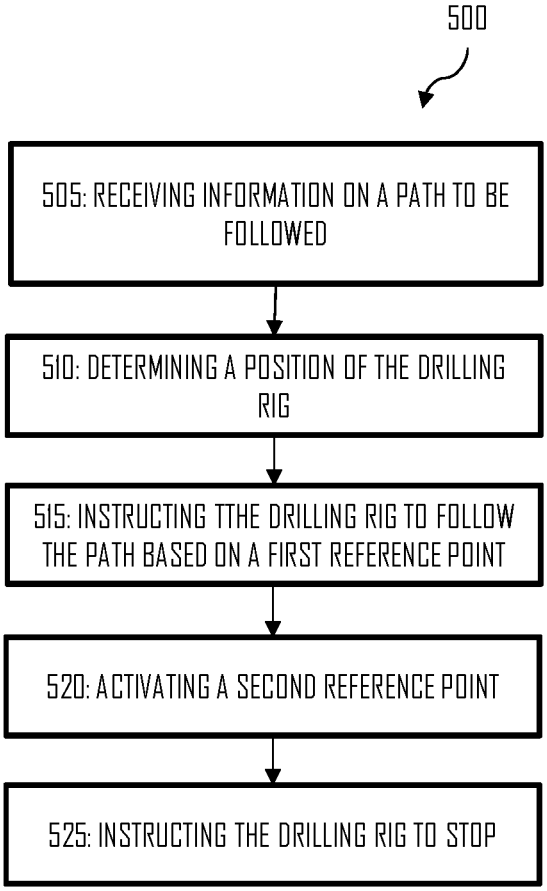
FIG. 5 shows an example method incorporating aspects of examples of the invention.

FIG. 5 illustrates an example method 500 incorporating aspects of the previously disclosed embodiments. More specifically, the example method 500 illustrates activating a reference point. The method may be performed by the apparatus 200.

The method starts with receiving 505 information on a path to be followed by a drilling rig, the path comprising a trigger position. The path may comprise a path to a target position or a path to the trigger position.

The method continues with determining 510 a position of the drilling rig. As mentioned above, the position of the drilling rig may comprise an absolute position or a relative position. An absolute position may comprise, for example, geographical coordinates such as global positioning system (GPS) coordinates. A relative position may comprise, for example, a position of the drilling rig with respect to a determined drill site. The apparatus 200 may be configured to determine a position of the drilling rig based on information received from a separate device or service, or the apparatus 200 may be configured to determine the position of the drilling rig.

The method further continues with instructing 515 the drilling rig to follow the path based on a first reference point associated with the drilling rig.

The method further continues with activating 520, in response to determining that the position of the drilling rig corresponds to the trigger position, a second reference point associated with the drilling rig. The second reference point may comprise, for example, a drill bit position.

The method further continues with instructing 525 the drilling rig to stop in response to determining that a position of the second reference point corresponds to a target position. The target position may comprise, for example, a position of a hole to be drilled.

Without limiting the scope of the claims, an advantage of activating a second reference point and instructing the drilling rig to stop based on the second reference point may be that the drilling can be stopped accurately to the target position. Another advantage may be that the first reference point may be used for following the path and the second reference point may be used for stopping. A further advantage may be that the drilling bit may be positioned automatically.

Without in any way limiting the scope, interpretation, or application of the claims appearing below, a technical effect of one or more of the example embodiments disclosed herein is that the drill bit may be positioned accurately. Another technical effect is a more efficient way to drill holes. For example, the drilling rig may be instructed to follow a path based on the first reference point that is selected such that the drilling rig is easy to drive and the second reference point may be selected such that positioning of the drilling bit is as easy as possible. A further technical effect is that positioning may be performed automatically thereby enabling positioning the drill bit more accurately and faster than using manual positioning.

As used in this application, the term "circuitry" may refer to one or more or all of the following: (a) hardware-only circuit implementations (such as implementations in only analog and/or digital circuitry) and (b) combinations of hardware circuits and software, such as (as applicable): (i) a combination of analog and/or digital hardware circuit(s) with software/firmware and (ii) any portions of hardware processor(s) with software (including digital signal processor(s)), software, and memory(ies) that work together to cause an apparatus, such as a mobile phone or server, to perform various functions) and (c) hardware circuit(s) and or processor(s), such as a microprocessor(s) or a portion of a microprocessor(s), that requires software (e.g., firmware) for operation, but the software may not be present when it is not needed for operation.

This definition of circuitry applies to all uses of this term in this application, including in any claims. As a further example, as used in this application, the term circuitry also covers an implementation of merely a hardware circuit or processor (or multiple processors) or portion of a hardware circuit or processor and its (or their) accompanying software and/or firmware. The term circuitry also covers, for example and if applicable to the particular claim element, a baseband integrated circuit or processor integrated circuit for a mobile device or a similar integrated circuit in server, a cellular network device, or other computing or network device.

Embodiments of the present invention may be implemented in software, hardware, application logic or a combination of software, hardware and application logic. The software, application logic and/or hardware may reside on the apparatus, a separate device or a plurality of devices. If desired, part of the software, application logic and/or hardware may reside on the apparatus, part of the software, application logic and/or hardware may reside on a separate device, and part of the software, application logic and/or hardware may reside on a plurality of devices. In an example embodiment, the application logic, software or an instruction set is maintained on any one of various conventional computer-readable media. In the context of this document, a 'computer-readable medium' may be any media or means that can contain, store, communicate, propagate or transport the instructions for use by or in connection with an instruction execution system, apparatus, or device, such as a computer, with one example of a computer described and depicted in FIG. 2. A computer-readable medium may comprise a computer-readable storage medium that may be any media or means that can contain or store the instructions for use by or in connection with an instruction execution system, apparatus, or device, such as a computer.

If desired, the different functions discussed herein may be performed in a different order and/or concurrently with each other. Furthermore, if desired, one or more of the above-described functions may be optional or may be combined.

Although various aspects of the invention are set out in the independent claims, other aspects of the invention comprise other combinations of features from the described embodiments and/or the dependent claims with the features of the independent claims, and not solely the combinations explicitly set out in the claims.

It will be obvious to a person skilled in the art that, as the technology advances, the inventive concept can be implemented in various ways. The invention and its embodiments are not limited to the examples described above but may vary within the scope of the claims.

The invention claimed is:

1. An apparatus comprising at least one processor and at least one memory including computer program code, the at least one memory and the computer program code being configured to, with the at least one processor, cause the apparatus at least to:

receive information on a path to be followed by a drilling rig, the path including a trigger position for selecting a reference point associated with the drilling rig;

determine a position of the drilling rig;

instruct the drilling rig to follow the path based on a first reference point associated with the drilling rig, a position of the first reference point being considered as a position of the drilling rig by a position control algorithm controlling movement of the drilling rig;

activate, in response to determining that the position of the drilling rig corresponds to the trigger position, a second reference point associated with the drilling rig, a position of the second reference point being considered as the position of the drilling rig by the position control algorithm controlling movement of the drilling rig; and instruct the drilling rig to stop in response to determining that the position of the second reference point corresponds to a target position for performing an operation using the drilling rig, while the drilling rig is so positioned at the second reference point.

2. The apparatus according to claim 1, wherein the target position comprises a position of a hole to be drilled.

3. The apparatus according to claim 1, wherein the second reference point associated with the drilling rig comprises a drill bit position.

4. The apparatus according to claim 1, wherein the path comprises a path to the target position.

5. The apparatus according to claim 1, wherein the path comprises a path to the trigger position.

6. The apparatus according to claim 5, wherein the apparatus is configured to determine a path from the trigger position to the target position.

7. The apparatus according to claim 4, wherein the apparatus is configured to instruct the drilling rig to follow a path from the trigger position to the target position based on the first reference point.

8. The apparatus according to claim 4, wherein the apparatus is configured to instruct the drilling rig to follow a path from the trigger position to the target position based on the second reference point.

9. The apparatus according to claim 8, wherein the apparatus is configured to generate for avoiding gaps in position information of the drilling rig, an additional path from the position of the second reference point to the trigger position when activating use of the second reference point as the position of the drilling rig by the position control algorithm.

10. The apparatus according to claim 1, wherein the first reference point is different from the second reference point.

11. The apparatus according to claim 1, wherein the trigger position comprises a position within a pre-determined distance from the target position.

12. The apparatus according to claim 1, wherein the trigger position comprises a portion of the path.

13. A method comprising:

receiving information on a path to be followed by a drilling rig, the path including a trigger position for selecting a reference point associated with the drilling rig;

determining a position of the drilling rig;

instructing the drilling rig to follow the path based on a first reference point associated with the drilling rig, a position of the first reference point being considered as a position of the drilling rig by a position control algorithm controlling movement of the drilling rig;

activating, in response to determining that the position of the drilling rig corresponds to the trigger position, a second reference point associated with the drilling rig, a position of the second reference point being considered as the position of the drilling rig by the position control algorithm controlling movement of the drilling rig; and instructing the drilling rig to stop in response to determining that the position of the second reference point corresponds to a target position, while the drilling rig is so positioned at the second reference point.

14. A non-transitory computer readable medium including instructions for causing an apparatus to perform at least the following:

receiving information on a path to be followed by a drilling rig, the path including a trigger position for selecting a reference point associated with the drilling rig;

determining a position of the drilling rig;

instructing the drilling rig to follow the path based on a first reference point associated with the drilling rig, a position of the first reference point being considered as a position of the drilling rig by a position control algorithm controlling movement of the drilling rig;

activating, in response to determining that the position of the drilling rig corresponds to the trigger position, a second reference point associated with the drilling rig, a position of the second reference point being considered as the position of the drilling rig by the position control algorithm controlling movement of the drilling rig; and instructing the drilling rig to stop in response to determining that the position of the second reference point corresponds to a target position for performing an operation using the drilling rig, while the drilling rig is so positioned at the second reference point.

15. A drilling rig comprising an apparatus according to claim 1.

* * * * *